US005345670A

United States Patent [19]

Pitzele et al.

[11] Patent Number: 5,345,670

[45] Date of Patent: Sep. 13, 1994

[54] METHOD OF MAKING A SURFACE-MOUNT POWER MAGNETIC DEVICE

[75] Inventors: Lennart D. Pitzele, Rockwall; Matthew A. Wilkowski, Mesquite, both of Tex.

[73] Assignee: AT&T Bell Laboratories, Murray Hill, N.J.

[21] Appl. No.: 989,394

[22] Filed: Dec. 11, 1992

[51] Int. Cl.[5] ..... H01F 41/10

[52] U.S. Cl. ..... 29/606; 29/827; 29/856; 336/83; 336/192; 336/223; 264/272.19

[58] Field of Search ..... 29/606, 602.1, 827, 29/856; 336/192, 198, 223, 83; 264/272.19

[56] References Cited

U.S. PATENT DOCUMENTS

| | | | |
|---|---|---|---|
| 3,857,146 | 12/1974 | Engdahl | 29/25.35 |
| 3,913,195 | 10/1975 | Beaver | 29/25.35 |
| 5,179,365 | 1/1993 | Raggi | 336/65 |

*Primary Examiner*—Carl E. Hall

*Attorney, Agent, or Firm*—Robert B. Levy

[57] ABSTRACT

A magnetic device (10), suitable for attachment to a substrate, includes at least one sheet winding (24) having a pair of spaced-apart terminations (26), each receiving an upwardly rising portion (28) of a lead (12). The sheet winding terminations and upwardly-rising lead portions, together with at least a portion of the sheet windings, are then encapsulated with masses of insulative material (18, 19 and 34). A ferromagnetic core (20,22) surrounds at least a portion of the sheet windings to impart a desired magnetic property to the device.

5 Claims, 2 Drawing Sheets

METHOD OF MAKING A SURFACE-MOUNT POWER MAGNETIC DEVICE

TECHNICAL FIELD

This invention relates generally to a magnetic device, such as an inductor or a transformer, especially suited for mounting on a surface of a substrate, and to a method of making such a magnetic device.

BACKGROUND OF THE INVENTION

Power magnetic devices, such as inductors and transformers, are employed in many different types of electrical circuits, such as power supply circuits for example. In practice, most power magnetic devices are fabricated of one or more windings, formed by an electrical member, such as a wire of a circular or rectangular cross section, or a planar conductor, which is wound or mounted to a bobbin of insulative material, e.g., plastic or the like. In some instances, the electrical member is soldered to terminations on the bobbin. Alternatively, the electrical member may be threaded through the bobbin for connection directly to a metallized area on a circuit board. A ferromagnetic core is typically affixed about the bobbin to impart a greater reactance to the power magnetic device.

As with other types of electronic components, there is a trend in the design of power magnetic devices towards achieving increased density and higher power. To achieve higher power, the resistance of the power magnetic device must be reduced, typically, by increasing the cross-sectional area of the electrical member forming the device winding(s). To increase the density of the power magnetic device, the bobbin is usually made very thin in the region constituting the core of the device to optimize the electrical member resistance. Conversely, the remainder of the bobbin is usually made thick to facilitate attachment of the electrical member to the bobbin terminals and/or to facilitate attachment of terminals on the bobbin to a circuit board. As a result of the need to make such a bobbin thin in some regions and thick in others, the bobbin is often subject to stresses at transition points between such thick and thin regions.

Another problem associated with present-day power magnetic devices is the lack of planarity of the device terminations. Because of the need to optimize the winding thickness of the power magnetic device in order to provide the requisite number of turns while minimizing the winding resistance, the thickness of the electrical member forming each separate winding of the device is often varied. The variation in the winding thickness often results in a lack of planarity of the device terminations, which is especially critical when the device is to be mounted onto a surface of a substrate such as a printed circuit board.

Thus, there is need for a power magnetic device which substantially overcomes the deficiency of past devices.

SUMMARY OF THE INVENTION

Briefly, in accordance with a preferred embodiment, there is provided a power magnetic device which is especially well suited for attachment to the surface of a substrate. The power magnetic device comprises at least one sheet winding having a pair of spaced-apart terminations. Each sheet winding termination at least partially receives an upwardly rising portion of a separate lead lying coplanar with every other lead. The sheet winding terminations and upwardly rising portion of each lead, together with the sheet winding itself, are encapsulated with an insulative material such that each lead has a portion extending out from the encapsulant. A ferromagnetic core surrounds at least a portion of the sheet winding(s) to impart a greater reactance to the power magnetic device. The portion of each lead of the power magnetic device extending out from the encapsulant is typically formed to facilitate attachment of the power magnetic device to a surface of a substrate such as a printed wiring board or the like.

DETAILED DESCRIPTION

Figure 1:
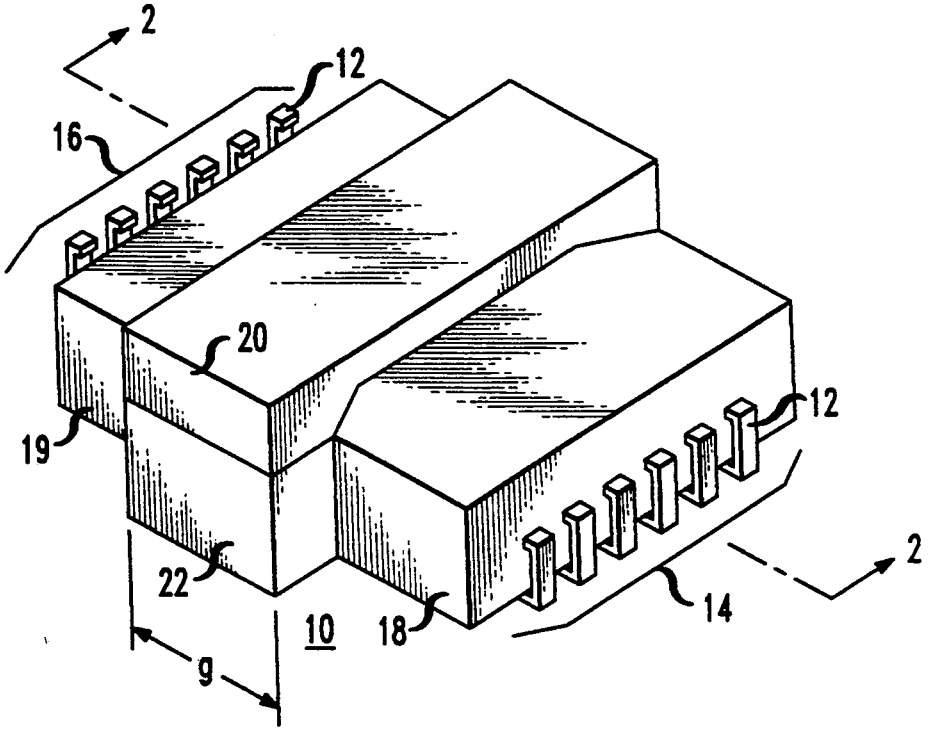
FIG. 1 is a perspective view of a power magnetic device in accordance with a preferred embodiment of the invention.

FIG. 1 shows a power magnetic device 10 in accordance with the invention. The device 10 has a plurality of leads 12 which, in the illustrated embodiment of FIG. 1, are arranged in two opposed banks 14 and 16. While the illustrated embodiment is depicted as having four and six leads in the banks 14 and 16, respectively, a greater or lesser number of leads is possible. Each of the leads 12 in each of the banks 14 and 16 extends out from a separate one of a pair of insulative bodies 18 and 19 spaced apart by a gap g. The gap g between the bodies 18 and 19 is enclosed by a pair of core halves 20 and 22 lying in opposed, face-to-face relationship. Each of the core halves 20 and 22 is fabricated from a ferromagnetic material.

Figure 2:
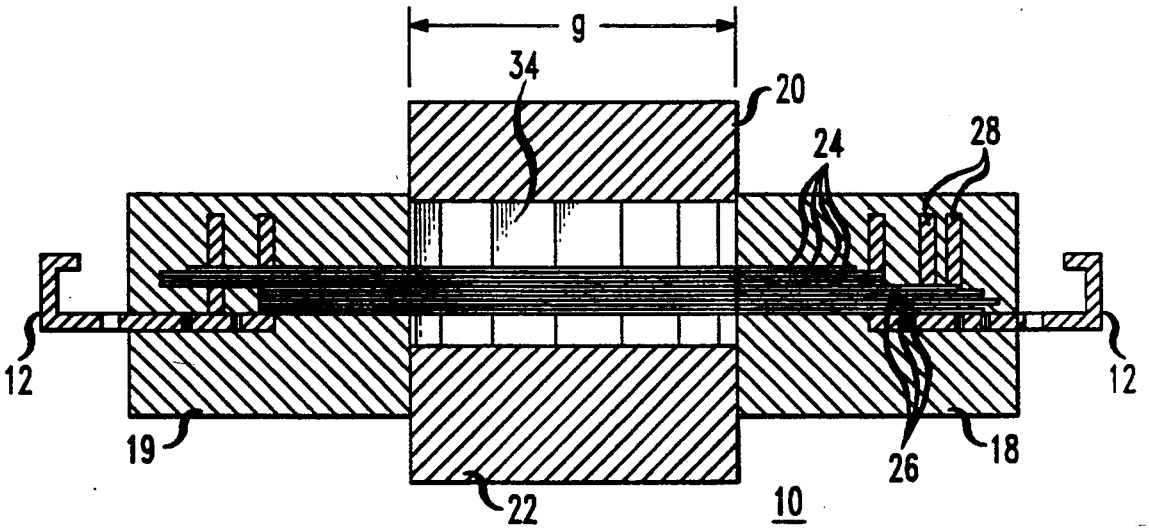
FIG. 2 is a cross-sectional view of the device of FIG. 1.
Figure 3:
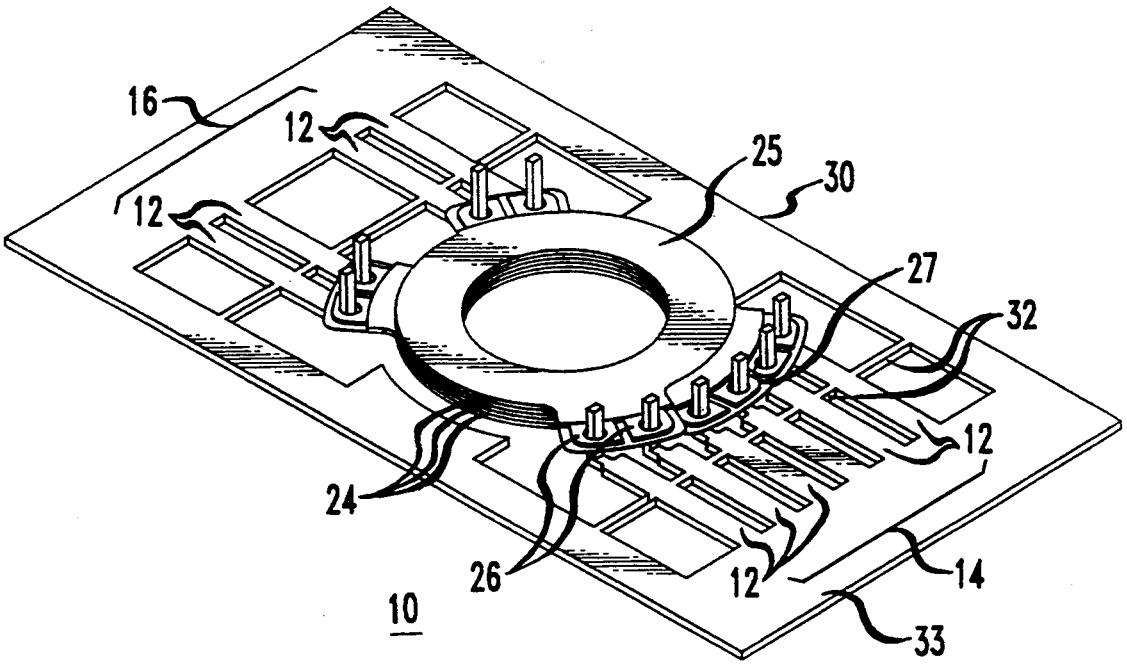
FIG. 3 is a perspective view of an assembly comprised of a lead frame stock on which sheet windings are layered to fabricate the device of FIG. 1.

Referring now to FIG. 2, at the heart of the power magnetic device 10 is at least one, and preferably a plurality of sheet windings 24. The details of each sheet winding are best seen in FIG. 3. Referring to FIG. 3, each sheet winding 24 is comprised of a generally circular conductive element 25 having a pair of radially, outwardly extending, spaced-apart terminations 26, each having an aperture 27 therethrough. Preferably, the conductive member 25 may be formed of a unitary structure which is punched or etched from a metallic strip of copper or the like and coated with a dielectric. Alternatively, the conductive member 25 of each sheet winding 24 may be formed of a flat, wound-wire coil.

In practice, the power magnetic device 10 is fabricated in the following manner. Referring to FIG. 3, a lead frame stock 30 is first fabricated from a strip of metal, such as copper or the like. The lead frame stock 30 is either punched or etched, and then is manipulated to create the opposed banks 14 and 16 of leads 12 such that each lead is provided with the upwardly rising portion 28. In the process of fabricating the lead frame stock 30, the leads 12 of each of the banks 14 and 16 are made integral to each other by way of a set of internal webs or dams 32, and by a flashing 33 about the periphery of the leads.

After fabrication of the lead frame stock 30, then at least one, and preferably a plurality of the sheet windings 24 are stacked one above the other such that the aperture 27 in each sheet winding termination 26 receives the upwardly rising portion 28 of a separate one of the leads 12 in a particular one of the banks 14 and 16. As may now be appreciated, the sheet windings 24 can be of the same or different thicknesses, provided that the combined thickness of all the sheet windings is less than the height of the upwardly rising portion 28 of each lead 12. Thus, the sheet windings 24 can vary in thickness without adversely affecting the planarity of the leads 12.

Once the sheet windings 24 are stacked one above the other, as seen in FIG. 3, the sheet winding terminations 26 are soldered or otherwise mechanically bonded to the corresponding, upwardly rising lead portions 28, using a mass reflow bonding technique as is well known in the art. The lead frame stock 30 of FIG. 2 is then placed in a mold (not shown) consisting of upper and lower mold halves. The sheet winding terminations 26 and the upwardly rising portion 28 of the leads 12 in each of the banks 14 and 16 reside in a pair of spaced-apart mold cavities (not shown) in the lower mold half, separated from the upper mold half by the lead frame stock 30. The lower mold half typically has an intermediate cavity (not shown) lying between the two cavities accommodating a separate one of the lead banks 14 and 16. The central cavity accommodates the central portion of the sheet windings 24. As will become better understood hereinafter, the depth of each of the two cavities accommodating the upwardly rising portion of the lead banks 14 and 16 is greater than that of the cavity accommodating the central portion of the sheet windings 24. It should be understood that the mold may be configured to mold a plurality of devices at one time.

During the molding process, a quantity of insulative encapsulant (not shown), typically plastic or the like, is then admitted into each mold cavity. Typically, the molding process employs high pressure (in excess of 350 psi) to force the insulative material into the mold cavities, thereby allowing the use of highly thermally filled materials which typically have a high viscosity and also eliminating air voids in such insulative material. The result of the molding process is the formation of the insulative bodies 18 and 19 of FIG. 2 which encapsulate the sheet winding terminations 26 and the upwardly rising lead portions 28 of each of the lead banks 14 and 16, respectively, and the formation of an insulative body 34 which encapsulates the central portion of the sheet windings 24. The insulative body 34 serves to impart a large measure of rigidity to the sheet windings 24. Note that the insulative body 34 is of a height much less than the height of the bodies 18 and 19, leaving an "open" region above and below the encapsulated stack of sheet windings.

Figure 4:
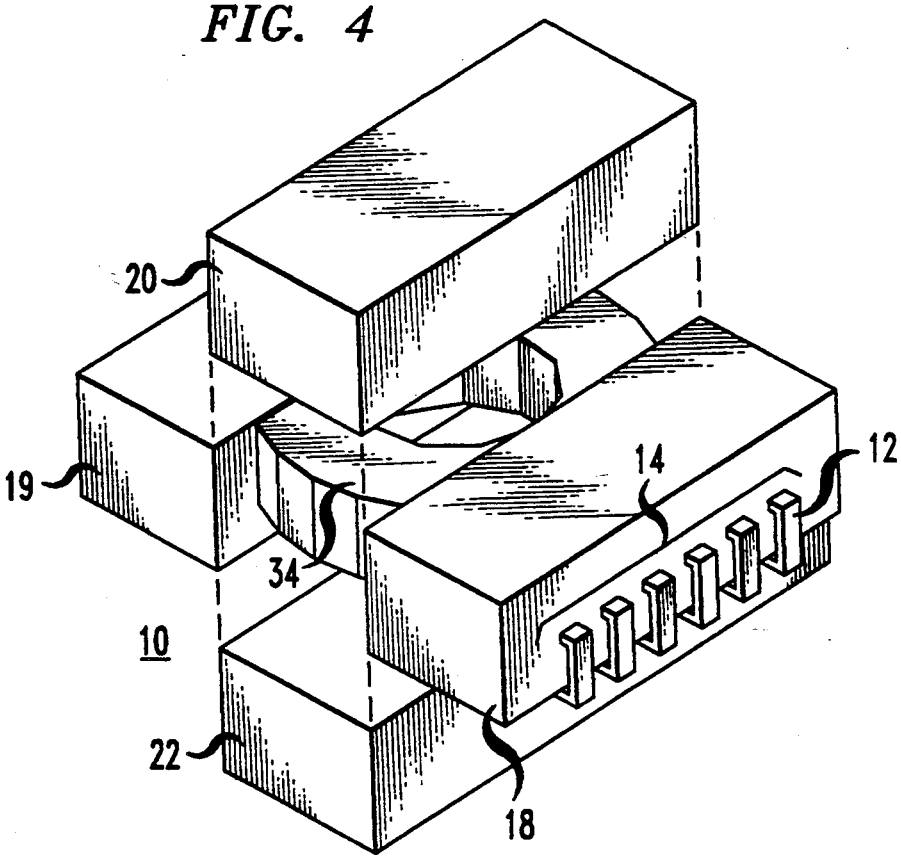
FIG. 4 is a perspective view of the assembly of FIG. 3 after encapsulation, showing how a core assembly is attached thereto to fabricate the power magnetic device of FIG. 1.

Referring to FIG. 4, after the molding process, then, each of the core halves 20 and 22, which are formed from a ferromagnetic material, is glued to the top and bottom of the insulative body 34, as best seen in FIG. 4, so as to fill the "open" regions thereabove and therebelow, respectively. Finally, the dams 32 and the peripheral flashing 33 of FIG. 3 of the lead frame stock 30 are trimmed from the leads 12, and the leads are then formed as seen in FIG. 4 to complete the magnetic device and facilitate its attachment to a surface of a substrate (not shown) such as a printed circuit board. Alternatively, the leads 12 could be formed for insertion in corresponding apertures in a circuit board. Rather than trim all of the dams 32, it may be desirable to allow selected ones of the dams to remain in place to effectively short-circuit one or more pairs of the leads 12 to increase the current-carrying capability of the device 10.

The above-described construction of the magnetic device 10 affords a number of distinct advantages. By molding the device 10 in the manner described, a far greater strength is afforded to the stack of sheet windings 24 than would be afforded by a conventional bobbin. Moreover, the fact that the device 10 is fabricated without a bobbin allows it to have a reduced size without any diminution in strength. Further, by molding the device 10 in the manner described, more highly thermally filled materials can be used, allowing for better heat dissipation, and also air voids in such material can be eliminated. By eliminating such air voids, the dielectric property of the insulation about the sheet windings is maintained at a high level. Additionally, fabricating the power magnetic device 10 from the lead frame stock 30 allows for greater co-planarity of the leads 12, which better facilitates attachment of the device 10 on the surface of a substrate. Also, the use of the lead frame 30 allows for assembly techniques, employed in the construction of integrated circuits, to be employed in fabricating the power magnetic device 10.

The foregoing describes a bobbinless power magnetic device 10 which offers increased strength and greater coplanarity as compared to devices utilizing a bobbin.

We claim:

1. A method of manufacturing a magnetic device for attachment to a substrate, comprising the steps of:

placing at least one generally planar sheet winding, having a pair of spaced-apart terminations, onto a lead frame stock such that each termination receives an upwardly rising portion of a separate lead integral with the lead frame stock so as to make an electrical connection with the winding termination;

encapsulating each sheet winding termination and the upwardly rising portion of each lead with a mass of insulative material;

attaching a ferromagnetic core about a portion of each sheet winding completely separating each lead from the lead frame stock; and forming each lead for attachment to a substrate.

2. The method according to claim 1 wherein a plurality of sheet windings are placed one above the other such that each sheet winding termination receives the upwardly rising portion of a separate lead of the lead frame.

3. The method according to claim 2 wherein the leads of the lead frame are arranged in two spaced-apart banks and wherein the step of encapsulating each sheet winding termination and upwardly rising portion of each lead includes the step of molding a mass of insulative material about each bank of leads.

4. The method according to claim 1 wherein the step of attaching a core comprises gluing each of a pair of core halves on opposite sides of a portion of each sheet winding.

5. The method according to claim 1 further including the step of solder-bonding each sheet winding termination to the upwardly rising portion of a separate lead.

* * * * *